United States Patent [19]

Farrall

[11] Patent Number: 4,572,982

[45] Date of Patent: Feb. 25, 1986

[54] APPARATUS FOR REDUCING THE EFFECTS OF THERMAL STRESSES ON BREAKDOWN VOLTAGE IN HIGH VOLTAGE VACUUM DEVICES

[75] Inventor: George A. Farrall, Rexford, N.Y.

[73] Assignee: General Electric Company, Schenectady, N.Y.

[21] Appl. No.: 557,987

[22] Filed: Dec. 5, 1983

[51] Int. Cl.[4] ..... A47B 88/00

[52] U.S. Cl. ..... 313/348; 313/614; 378/143

[58] Field of Search ..... 313/348, 614; 378/143

[56] References Cited

U.S. PATENT DOCUMENTS

| | | | |
|---|---|---|---|
| 1,279,423 | 9/1918 | Pfanstiehl | 378/143 |
| 1,894,806 | 1/1933 | Whitaker | 313/614 X |
| 2,037,533 | 4/1936 | Prince | 313/614 |
| 2,115,855 | 5/1938 | Holman | 313/348 X |
| 3,914,633 | 10/1975 | Hildebrand et al. | 378/143 |

OTHER PUBLICATIONS

V. A. Gaponov et al., "Breakdown Strength of a Large Vacuum Gap with An Anode Grid," *Soviet Physics-Technical Physics,* vol. 22, No. 2, pp. 242–245, (Feb. 1977).

D. K. Davies et al., "Emission of Electrode Vapor Resonance Radiation at the Onset of DC Breakdown in Vacuum," *Journal of Applied Physics,* vol. 48, No. 10, pp. 4229–4233, (Oct. 1977).

*Primary Examiner*—Robert Lindsay

*Attorney, Agent, or Firm*—William H. Steinberg; James C. Davis, Jr.; Marvin Snyder

[57] ABSTRACT

An anode structure for use in high voltage vacuum devices which reduces the effects of thermal stresses on breakdown voltage includes an anode having at least one flat surface and a mesh of electrically conductive material disposed adjacent to the flat surface. The mesh serves to reduce the electric field on the surface of the anode which faces the cathode of a vacuum device, thereby reducing the electrostatic force in the direction of the cathode on both particles dislodged from the surface of the anode by electrons from the cathode striking the anode, and free particles found in the evacuable volume of the vacuum device. The mesh may either overlay the surface of the anode, so that it is in direct contact with the anode surface, or, alternatively, it may be supported in a spaced-apart relationship with the anode surface by a plurality of posts located between the mesh and the anode surface.

9 Claims, 5 Drawing Figures

APPARATUS FOR REDUCING THE EFFECTS OF THERMAL STRESSES ON BREAKDOWN VOLTAGE IN HIGH VOLTAGE VACUUM DEVICES

BACKGROUND OF THE INVENTION

This invention relates to reducing the effects on breakdown voltage of thermal stresses in high voltage vacuum devices. More particularly, it relates to reducing the electrostatic forces at the anode surface of such a device, which forces propel particles from the anode toward the cathode and thereby contribute to breakdown.

In high voltage vacuum devices such as x-ray tubes, the ability to withstand high voltage across the cathode-to-anode gap without breakdown is often limited by the mechanical and thermal properties of the material used for the anode. It is known from field emission theory that one of the mechanisms of breakdown involves electron beam interaction with the anode surface. Prior to breakdown, field emitted electrons are formed at the cathode. Alternatively, electrons may be generated thermionically at the cathode. These electrons traverse the cathode-to-anode gap and strike the anode. Since the electrons have gained the full potential energy associated with the voltage across the gap, upon impact with the anode they act to heat and dislodge solid or liquid particles of anode material. Movement of the dislodged anode particles has three principal effects. First, because the particles have acquired a positive charge from the anode, and because there is an electric field across the gap between the anode and the cathode, the particles move upstream in the beam of incident field emitted electrons. In their motion toward the cathode, the particles become heated, vaporized, and ionized, leaving a plasma column in their wake. This column becomes the path along which electrical conduction is established in the initial stages of breakdown. Secondly, the plasma column, and perhaps even the unvaporized dislodged particles themselves, effectively extend the anode surface toward the cathode, thereby shortening the cathode-to-anode gap. Since the electric field strength produced by voltage across the gap is inversely proportional to the length of the gap, the field strength is increased when the gap length is decreased. The third effect of movement of dislodged particles occurs when the particles completely traverse the gap and strike the cathode. The result is essentially breakdown of the dielectric gap and electrical conduction between the cathode and the anode.

In the past, the general approach to the problem of breakdown involving particles dislodged from the anode has been to use an anode material of relatively high thermal stability, such as molybdenum or tungsten. Another approach has been to coat the surface of the anode with a material having high thermal stability, such as a rhenium-tungsten alloy. While these approaches improve the dielectric performance by lengthing the time before particles become dislodged and/or reducing the number of dislodged particles, breakdown ultimately occurs by the same type of electron beam-anode interaction as described above.

Furthermore, it is known that electrical breakdown can also be caused by the presence of free particles within the evacuated volume, by the same type of mechanisms as for particles dislodged from the anode. Free particles contacting the anode surface acquire a positive charge and move toward the cathode in the same manner as particles dislodged from the anode. Movement of these charged free particles has similar effects as movement of dislodged anode particles.

Accordingly, it is an object of the present invention to reduce the effects of thermal stresses on breakdown voltage in high voltage vacuum devices.

It is a further object of the present invention to reduce the movement of dislodged anode particles in a direction toward the cathode.

It is also an object of the present invention to reduce the movement of free particles in the evacuated volume in a direction toward the cathode.

SUMMARY OF THE INVENTION

An anode structure which reduces the effects of thermal stresses on breakdown voltage in high voltage vacuum devices comprises an anode having at least one flat surface and a mesh of electrically conductive material disposed adjacent to the flat surface, so that the electric field on the surface of the anode is reduced. In accordance with one embodiment of the invention, the mesh overlays the flat surface of the anode, so that the mesh is in direct contact with the anode surface. In another embodiment, the mesh is supported in a spaced-apart relationship with the anode surface by a plurality of posts located between the mesh and the anode surface.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE INVENTION

Figure 1:
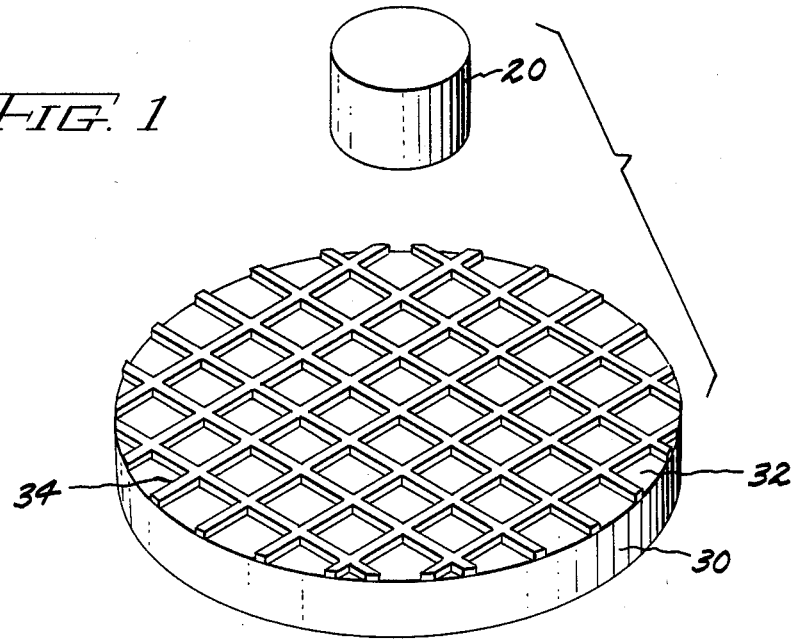
FIG. 1 is a perspective view schematically illustrating one embodiment of the present invention.

FIG. 1 schematically depicts an apparatus for use in high voltage vacuum devices which reduces the effects of thermal stresses on breakdown voltage, in accordance with one embodiment of the present invention. Cathode 20 and anode 30 are each connected to external circuitry by means not shown in FIG. 1. In a completed vacuum device, the apparatus shown in FIG. 1 is enclosed in an evacuable vessel, also not shown. Anode 30 has at least one flat surface 32. As used herein, the term "flat surface" includes isomorphic structures, such as, for example, cylindrical or (frusto-) conical surfaces. Located between cathode 20 and anode 30 is mesh 34 of electrically conductive material. Mesh 34 is disposed adjacent to surface 32 of anode 30 so as to reduce the electric field on surface 32. In the embodiment shown in FIG. 1, mesh 34 overlays surface 32 of anode 30, so that mesh 34 is in direct contact with surface 32. Since mesh 34 is physically closer to cathode 20 than surface 32 is to cathode 20, and since mesh 34 is electrically common with surface 32, mesh 34 serves to reduce the electric field at surface 32. The electrostatic force which propels particles dislodged from surface 32 toward cathode 20 is thereby also significantly reduced. When the electric field at surface 32 is reduced to the level where the electrostatic force exerted on particles dislodged from surface 32 does not exceed the particle "image force" at surface 32, the dislodged particles are not propelled toward cathode 20. Thus, even if particles are dislodged from surface 32 by electrons from cathode 20 striking anode 30, the dislodged particles are not as likely to be projected toward cathode 20. Hence, the effects of particles dislodged by thermal stresses on breakdown voltage, associated with the breakdown mechanisms of plasma formation, gap reduction, and electrical conduction discussed above, are greatly reduced. In a similar manner, the effect on breakdown of free particles within the evacuable volume of a vacuum device are also reduced. Even if free particles contact surface 32 of anode 30 and acquire a positive charge, since the electric field at surface 32 is significantly reduced by the presence of mesh 34, the electrostatic force on these charged free particles in a direction towards cathode 20 is also significantly reduced. For the same reasons as for dislodged particles, the effects of the breakdown mechanisms associated with particle movement toward the cathode are therefore reduced.

Mesh 34 should be configured so that it is substantially transparent to electron beams passing from cathode 20 to anode 30. As used herein, by "transparent" it is meant that electrons traversing the cathode-to-anode gap pass through the apertures in mesh 34 and strike surface 32 of anode 30, rather than striking mesh 34. For transparency, it is desirable that the apertures in the mesh be as large as possible. However, if the mesh apertures are too large, the electric field on the anode surface underlying the apertures will not be significantly reduced, and this constraint represents an upper limit on desirable mesh size. While mesh 34 has been shown as a rectangular grid, it should be understood that the present invention is not limited to such a structure. Any mesh structure which reduces the electric field on the surface of the anode, by acting as a termination point for electric field lines originating at the cathode, while at the same time being transparent to electrons passing from the cathode to the anode, may be used. Preferably, mesh 34 and anode 30 comprise refractory metal, such as, for example, molybdenum, tungsten, or alloys thereof.

Figure 2:
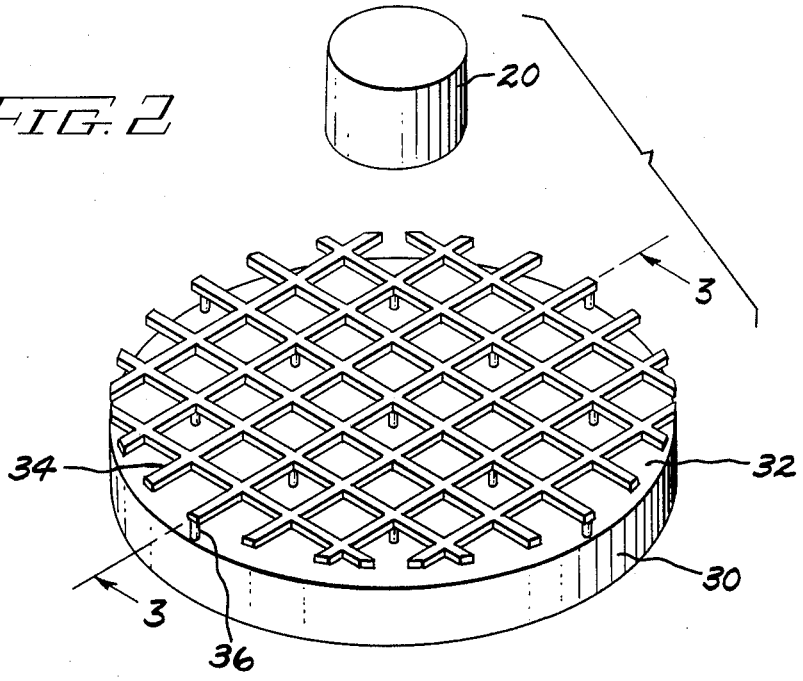
FIG. 2 is a perspective view schematically illustrating another embodiment of the present invention.

An alternative embodiment of the present invention is schematically depicted in FIG. 2. In the embodiment shown therein, mesh 34 is supported in a spaced-apart relationship with surface 32 of anode 30 by a plurality of posts 36. Posts 36 are located between mesh 34 and surface 32. One end of each post 36 is attached to mesh 34 and the opposite end thereof is attached to surface 32 of anode 30. As illustrated by the alternative embodiments shown in FIGS. 3 and 4, which are cross-sectional side views taken along line 3—3 of FIG. 2, post 36 may comprise either an electrically conducting material or an electrically insulating material, respectively.

Figure 3:
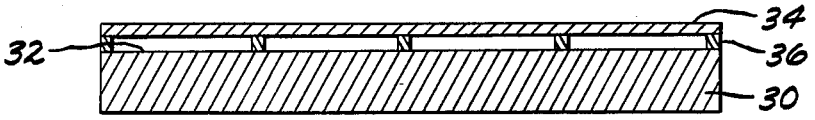
FIGS. 3, 4, and 5 are side views in cross-section of alternative embodiments of the apparatus shown in FIG. 2, taken along line 3—3.

For the embodiment shown in FIG. 3, where mesh 34 and anode 30 are electrically common, the effects on the electric field at surface 32 and on particle movement are similar to those described above for the embodiment shown in FIG. 1. The primary difference is that the effects are further enhanced by the embodiment shown in FIG. 3. With mesh 34 spaced apart from surface 32, while being electrically common with surface 32, the electric field at surface 32 is so reduced that an essentially field-free volume exists at surface 32.

Figure 4:
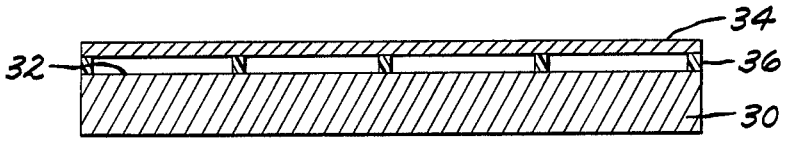

In the embodiment shown in FIG. 4, mesh 34 is electrically insulated from anode 30, so that mesh 34 and anode 30 may be at different electric potentials. If mesh 34 is biased at a potential slightly positive with respect to the potential of anode 30, the space between surface 32 and mesh 34 acts as a particle trap. For this embodiment of the invention, particles dislodged from surface 32 by incident electrons from cathode 20 have a negative charge. Due to the electric field produced by the slight difference in potential between mesh 34 and anode 30, a relatively small electrostatic force is exerted on the dislodged particles which propels them toward mesh 34. However, if the particles pass through the apertures in mesh 34 in a direction toward cathode 20, they incur a strong electric field of opposite polarity which propels them back into the space between mesh 34 and surface 32. Free particles within the evacuable volume of the vacuum device, which strike surface 32 and thereby acquire a negative charge, follow the same path of movement. Thus, the region between surface 32 and mesh 34 acts as a particle trap which both reduces the movement of dislodged particles toward the cathode and scavenges free particles from within the vacuum enclosure.

Figure 5:
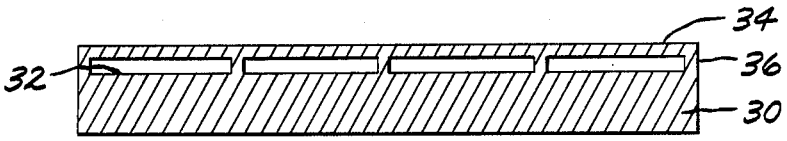

As illustrated in FIG. 5, which is also a cross-sectional side view taken along line 3—3 of FIG. 2, when posts 36 comprise electrically conducting material, posts 36 and mesh 34 may be formed as an integral part of anode 30. This embodiment is particularly useful for applications requiring high structural strength, such as, for example, the rotating anodes used in medical x-ray tubes.

The foregoing describes an apparatus that reduces the movement in a direction towards the cathode of both dislodged anode particles and free particles in the evacuable volume of a vacuum tube. By reducing the movement of these particles, the present invention reduces the effects of thermal stresses on breakdown voltage in high voltage vacuum devices and provides them with enhanced dielectric performance.

While the invention has been described in detail herein in accord with certain preferred embodiments thereof, many modifications and changes therein may be effected by those skilled in the art. For example, while the apparatus has been shown in FIGS. 1 and 2 as having a generally disc-shaped anode and a generally cylindrically shaped cathode, and while mesh 34 has been shown therein as rectangular in cross-section, it should be appreciated that other shapes and cross-sections may be employed. Accordingly, it is intended by the appended claims to cover all such modifications and changes as fall within the true spirit and scope of the invention.

What is claimed is:

1. An anode structure for use in high voltage vacuum devices having a cathode and not designed to operate in a plasma conducting state, the anode structure being especially useful for reducing the effects of thermal stresses on the breakdown voltage of high voltage vacuum devices, said anode structure comprising:

an anode having at least one flat surface; and a mesh of electrically conductive material disposed between said cathode and said anode, said mesh being disposed adjacent to said flat surface and said mesh apertures being configured so that it is substantially transparent to electron beams passing through the mesh from the cathode to the anode, so that electric fields in the vicinity of said surface are reduced, whereby particles dislodged from said surface by electrons striking said surface, and other particles in the vicinity of said surface, both tend to be retained in the space between said mesh and said surface.

2. The apparatus of claim 1 wherein said anode is substantially disc-shaped.

3. The apparatus of claim 1 wherein said mesh overlays said surface of said anode, so that said mesh is in direct contact with said surface.

4. The apparatus of claim 1 further comprising means for supporting said mesh in a spaced-apart relationship with said surface of said anode.

5. The apparatus of claim 4 wherein said supporting means comprises a plurality of posts located between said mesh and said anode surface, with one end of each said post attached to said mesh and the opposite end thereof attached to said anode surface.

6. The apparatus of claim 5 wherein said posts comprise electrically conductive material.

7. The apparatus of claim 6 wherein said posts and said mesh form an integral part of said anode.

8. The apparatus of claim 5 wherein said posts comprise electrically insulating material.

9. A high voltage vacuum device having the anode structure of claim 1, further comprising:

an evacuable vessel enclosing said cathode, said anode, and said mesh.

* * * * *